US005839428A

United States Patent [19]

Schroeter et al.

[11] Patent Number: 5,839,428

[45] Date of Patent: Nov. 24, 1998

[54] UNVENTED FUEL BURNING APPLIANCES AND DOOR THEREFORE

[75] Inventors: Wolfgang Schroeter, Midhurst; Cliff Lilley, Anten Mills; Richard Tjart, Wyevale, all of Canada

[73] Assignee: Napoleon Systems, Inc., Barrie, Canada

[21] Appl. No.: 40,180

[22] Filed: Mar. 18, 1998

[51] Int. Cl.[6] ..... F24C 3/00

[52] U.S. Cl. ..... 126/512; 126/544; 126/547

[58] Field of Search ..... 126/512, 544, 126/545, 547

[56] References Cited

U.S. PATENT DOCUMENTS 1,884,746 10/1932 Kline et al. ..... 126/92 AC
5,127,392 7/1992 Mizuno et al. ..... 126/92 R
5,678,534 10/1997 Fleming ..... 126/512

*Primary Examiner*—Carroll B. Dority
*Attorney, Agent, or Firm*—Merek & Voorhees

[57] ABSTRACT

An unvented fuel burning appliance that includes a firebox, a burner and a front door releasably securable to the firebox. The firebox has an open front and enclosed bottom, rear, side and top surfaces. The door has a central panel with a catalytic converter positioned on the upper portion of the central panel. Exhaust gases from the burner are directed through the catalytic converter prior to exiting the firebox such that the catalytic converter eliminates or reduces harmful or noxious gases and particulate material contained within the exhaust gases. Heat that is generated by the operation of the catalytic converter is substantially directed, by way of radiation and convection, outwardly through the front of the appliance to reduce heat generated and maintained at the top of the firebox and thereby reduce the heating of the top surface of the appliance.

17 Claims, 7 Drawing Sheets

UNVENTED FUEL BURNING APPLIANCES AND DOOR THEREFORE

FIELD OF THE INVENTION

This invention relates to unvented fuel burning appliances and doors that may be used on such appliances. In particular, the invention relates to unvented fuel burning, fireplaces, stoves, log sets, inserts and zero clearance appliances and their doors.

BACKGROUND OF THE INVENTION

For economic reasons and for case of installation unvented fuel burning appliances, and particularly unvented gas burning fireplaces and stoves, have become popular in recent years. In general, modern day natural gas, propane, kerosene and alcohol burners operate at high temperatures and high levels of efficiency so as to produce relatively few combustion by-products making it viable to utilize such burners, and appliances containing them, in a unvented configuration. Unfortunately such appliances suffer from a range of inherent limitations that often restrict or limit their application.

First and foremost, the efficient burning flames that create relatively few combustion by-products are typically bluish in colour and not the aesthetically pleasing yellow or orange flame that consumers have become accustomed to seeing in many fuel burning fireplaces, stoves and appliances. As a result, the use of the more visually pleasing, but less efficient, flame often prevails. Where the unvented appliance is situated in a large environment its exhaust bases can be readily expelled into the atmosphere such that they mix with local air and are diluted to the extent that they are neither harmful nor noxious. In such instances the lower level of efficiency is usually of little regard. However, where the appliance is installed in a home or a smaller commercial setting, the inefficiencies of a yellow or orange burning flame can result in the production of combustion by-products in quantities that are not able to be sufficiently diluted with room air to eliminate their harmful effects.

Secondly, conventional unvented fuel burning appliances, including those with catalytic converters, also tend to develop "hot-spots" on their upper surface and generally tend to have upper surfaces that are heated to significantly greater temperatures than, for example, direct vented appliances where the outer surface of the firebox is cooled by in-coming combustion air. Unvented appliances, as in the case of vented and direct vented appliances, may also be fitted with a front door for both aesthetic and safety reasons. In cases where a front door is utilized, the heating of the upper surface of the firebox is often enhanced since less heat is allowed to escape outwardly through the front of the appliance. The tendency of the upper surface of the firebox in unvented appliances to the develop "hot-spots" often requires the use of extra insulation and/or a series of baffles at the top of the firebox to prevent excessive heating and to allow for zero-clearance installations.

SUMMARY OF THE INVENTION

The invention provides a means to reduce or eliminate the production of harmful and noxious combustion by-products that are associated with unvented fuel burning appliances. The invention also minimizes hot-spots and excessive heating of the upper part of the firebox in such appliances. To that extent in one embodiment the invention comprises a front mounted catalytic converter to reduce or eliminate the emission of harmful or noxious gases and to reduce heat build-up at the top of the appliance. The invention also comprises a door for use on a unvented fuel burning appliance that includes a rigid exterior frames a central window and a catalytic converter to reduce or eliminate the omission of harmful or noxious gases.

In particular, in one of its aspects the invention provides a door for use on an unvented fuel burning appliance, the door comprising a central panel member, fastening means to allow said door to be releasably secured to the front of a fuel burning appliance, and, a catalytic converter, positioned in and near the top of said door, providing a means for the communication of air and gases through said door, such that when said door is installed on the front of a fuel burning appliance said catalytic converter is positioned on the upper front surface of the appliance requiring exhaust gases from the appliance to pass through said catalytic converter to escape the appliance, said catalytic converter reducing or eliminating the emission of harmful or noxious gases and particulate material in the exhaust gas created during the burning of fuel in the appliance, said catalytic converter further directing and radiating heat generated through its operation, and heat generated by said appliance, outwardly through the front of the appliance and reducing the amount of heat generated and maintained at the top of the appliance to thereby reduce the heating of the top surface of the appliance.

In a further aspect the invention provides an unvented fuel burning appliance comprising a firebox having an open front and having enclosed bottom, rear, side and top surfaces, a burners and, a front door releasably securable to said firebox, said door comprising a central panel member and a catalytic converter positioned on the upper portion of said central panel member, wherein exhaust gases from said burner are directed through said catalytic converter prior to exiting said firebox such that said catalytic converter eliminates or reduces harmful or noxious gases and particulate material contained within the exhaust gases, and wherein heat generated by the operation of said catalytic converter is substantially directed, by way of radiation and convection, outwardly through the front of said appliance to reduce heat generated and maintained at the top of said firebox and thereby reduce the heating of the top surface of said appliance.

In yet a further aspect the invention provides an unvented fuel burning appliance comprising a firebox having a partially enclosed front and having enclosed bottom, rear, side and top surfaces, a burner; and, a catalytic converter positioned on the upper portion of said partially enclosed front of said firebox, wherein exhaust gases from said burner are directed through said catalytic converter prior to exiting said firebox such that said catalytic converter eliminates or reduces harmful or noxious gases and particulate material within the exhaust gases, and wherein heat generated by the operation of said catalytic converter is substantially directed, by way of radiation and convection, outwardly through the front of said fireplace to reduce heat generated and maintained at the top of said firebox and thereby reduce the heating of the top surface of said appliance.

Further objects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

Figure 1:
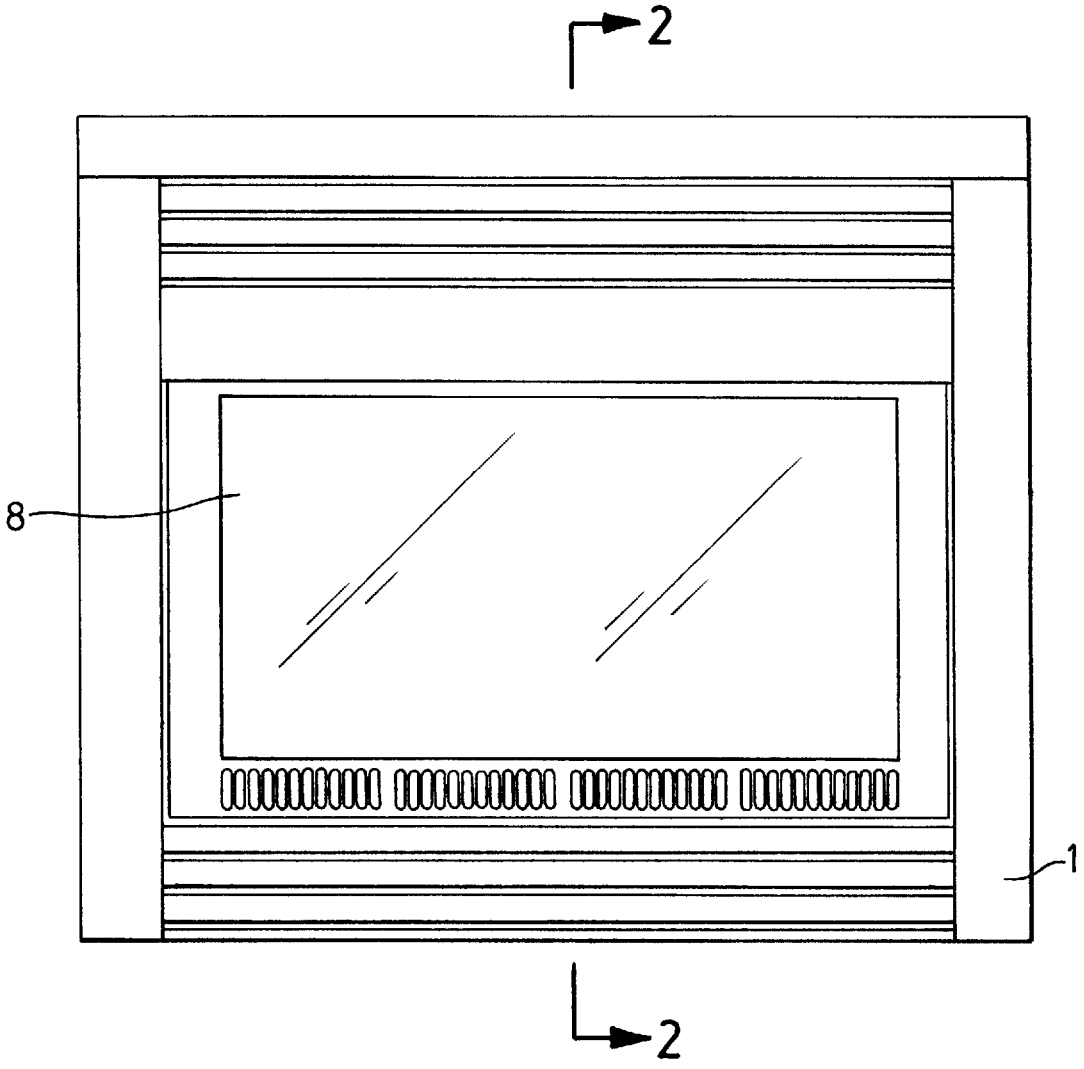
FIG. 1 is a front view of a gas fireplace having a door pursuant to the present invention.

The present invention may be embodied in a number of different forms. However, the specification and drawings that follow describe and disclose only some of the specific forms of the invention and are not intended to limit the scope of the invention as defined in the claims that fallow herein.

FIG. 1 through 6 show a first embodiment of the present invention. In this embodiment there is shown a fireplace 1 that generally includes a firebox 2, an exterior housing 3, a burlier 4, and a gas valve 5. The fireplace may also be equipped with air chambers or air wipes 6 that surround the firebox in order to allow room air to circulate around the firebox to increase the heat output of the appliance. In some instances a fan 7 is used to help supplement or increase the natural convection flow of room air about the firebox through air wipes 6. The fireplace may be of any fuel burning variety, including natural gas, propane, kerosene, oil or alcohol.

In an unvented fireplace the front of the firebox is often left open such that combustion air may be drawn in from the room within which the fireplace is situated and exhaust gases readily expelled back into the room. Pursuant to one embodiment of the present invention a door 8 is positioned in front of the firebox in order to effectively enclose it. As shown more clearly in FIGS. 2 and 3, door 8 comprises a central panel member 20 and preferably includes a rigid exterior frame 9 having a top portion 10, side portions 11 and a bottom portion 12. A central viewing window 13 is contained within the frame to effectively enclose the top, side and bottom portions. In the preferred embodiment a sealing material or gasket is positioned between viewing window 13 and the frame members in order to provide an air tight seal therebetween. In addition, so as to prevent cracking under thermal expansion during operation of the fireplace central viewing window 13 is preferably comprised of a heat resistant transparent panel that may be formed from heat resistant glass, ceramic material or other transparent panel.

Door 8 also includes fastening means to allow it to be releasably secured to the front of a fireplace or gas stove. It will be appreciated that depending upon the particular configuration of the fireplace or stove a wide variety of different fastening means could be used. In the configuration shown in the attached drawings the fastening means comprises inwardly projecting lip portions 14 located at top, side and bottom portions 10, 11 and 12 of the frame. Lip portions 14 are constructed so as to overlap the top, bottom and sides of the firebox when door 8 is positioned thereon such that screws or bolts can be inserted through lip portions 14 and into the firebox to securely hold the door in place. Alternately, the door could be attached to the side or front surface of the firebox through the use of hinges thereby allowing the door to be readily opened to clean and service the burner.

Preferably door 8 further includes sealing means 15 located along the interior of top portion 10 and along at least the upper part of side portions 11 of frame 9. Sealing means 15 may be comprised of a heat resistant gasket material, high temperature silicone, or other appropriate material that will withstand the heat to which door 8 and firebox 2 may be subjected during operation. Sealing means 15 provides an effective air-tight seal between at least the upper part of the door's frame and the firebox. It is anticipated that in most applications sealing means 15 will be applied circumferentially around the interior surface of frame 9 to create a complete seal around the frame.

Figure 2:
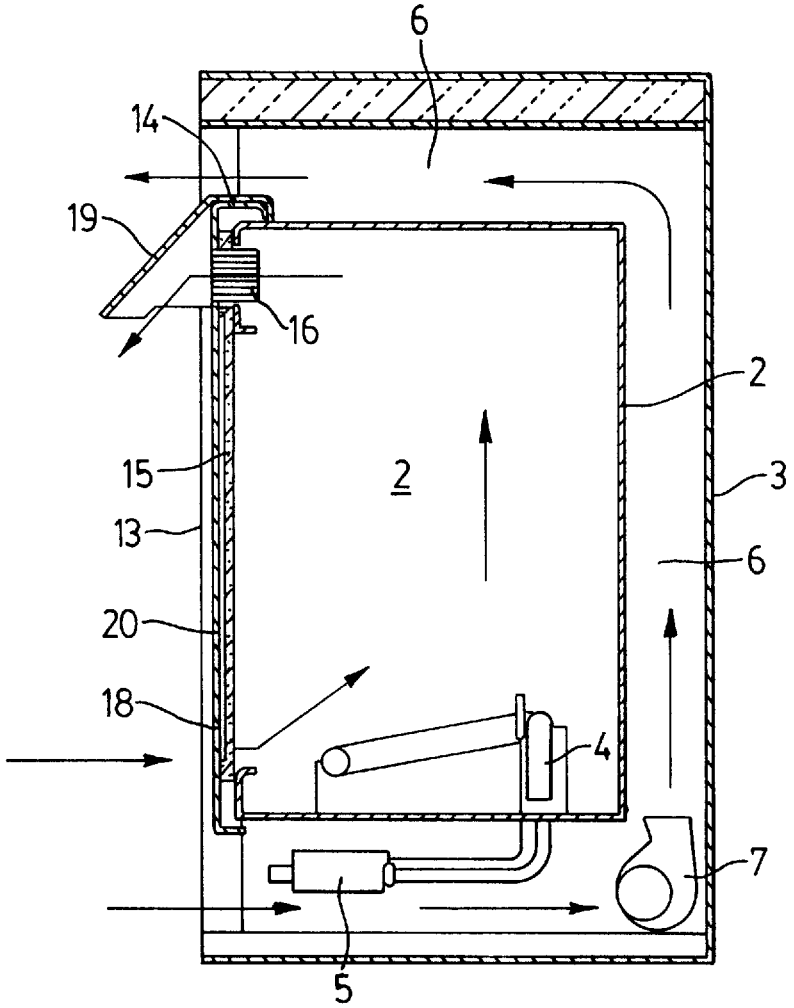
FIG. 2 is a sectional view taken along the line 2—2 in FIG. 1.
Figure 3:
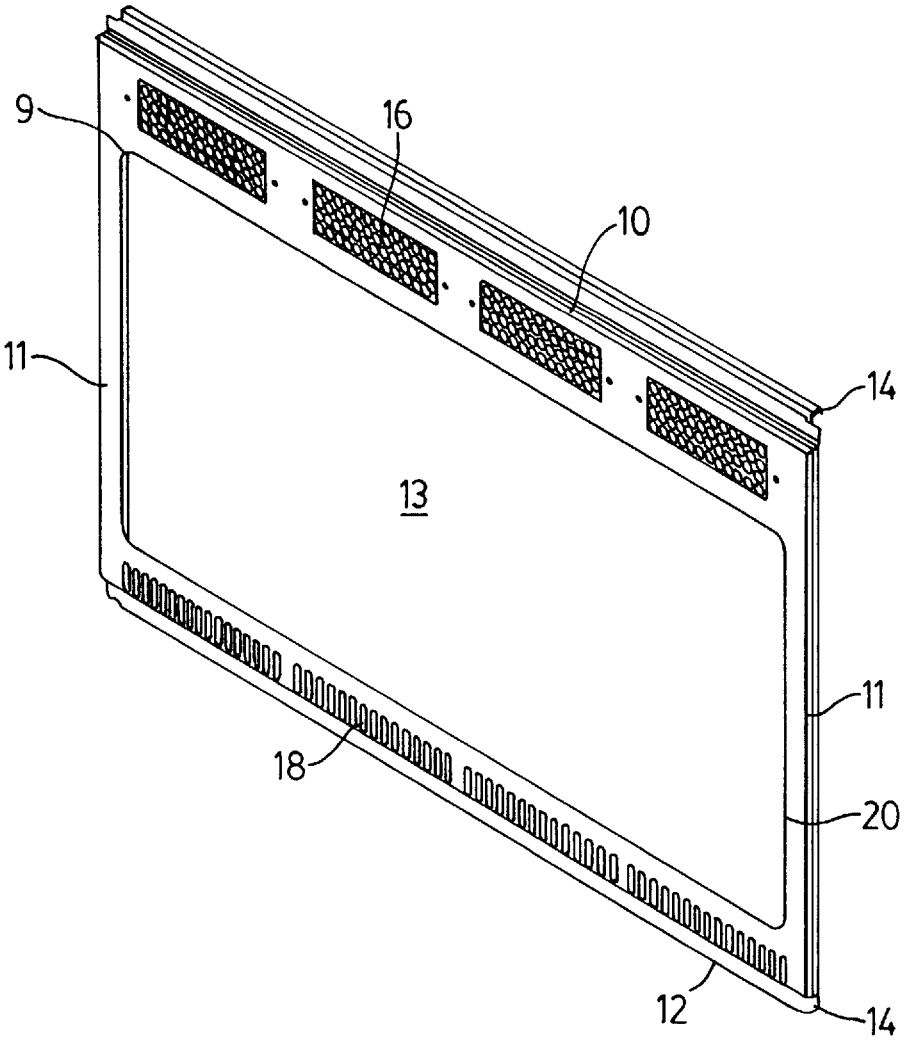
FIG. 3 is an upper front perspective of the door shown in FIG. 1 having its hood removed.

As shown in FIGS. 2 and 3, door 8 further includes at least one catalytic converter 16 positioned near top portion 10. Catalytic converter 16 is preferably a cellular or honeycomb type structure, having a number of independent channels or passageways that together form a central block. The independent passageways provide a means for the communication of air or gases through door 8 when it is installed on the front of firebox 2. With door 8 positioned and secured to the front of the firebox, and with catalytic converter 16 located on the upper front surface of the door, hot exhaust gases produced by burner 4 will rise within the firebox and be forced to pass through catalytic 16 in order to escape. As hot exhaust gases passes through the catalytic converter it effectively reduces or eliminates the emission of harmful or noxious gases and particulate material created from the burning of gaseous fuels. The positioning, of sealing means 15 along the top 10 of the frame and alone at least the upper part of sides 11 provides an air tight seal between door 8 and the upper portion of the firebox thereby forcing all exhaust gas to pass through catalytic converter 16 prior to being expelled from the firebox. It will therefore be appreciated that since exhaust gases are unable to escape the firebox without passage through catalytic converter 16, the emission of harmful combustion by-products will be substantially eliminated.

The structure and operation of catalytic converter 16 will now be described in more detail. As indicated, in the preferred embodiment catalytic converter 16 is comprised of a cellular or honeycomb structure having incorporated therein a number of small independent channels or passageways. It has been found that such a structure presents a relatively low back pressure that does not substantially restrict the flow of exhaust gas out of the firebox. In addition, the cellular or honeycomb structure as described presents a high surface area that may be contacted by exhaust gases in order to effectively "burn off" harmful emissions. The removal of harmful emissions from the exhaust gas is accomplished through the utilization of a noble metal coating on the cellular or honeycomb structure of catalytic converter 16. When heated by exhaust gas passing through the catalytic converter, the noble metal acts as a catalyst to eliminate harmful emissions.

It is expected that in most instances fireplace 1 will burn natural gas or propane. Since natural gas and propane are relatively clean burning fuels the primary noxious or harmful exhaust components include carbon monoxide, nitrogen dioxide and hydrocarbon articulates. Catalytic converter 16 chemically converts carbon monoxide to carbon dioxide and limits the expulsion of nitrogen dioxide and other hydrocarbons. It has been found that through use of a catalytic converter as described the emission of carbon monoxide is essentially eliminated and the amount of expelled nitrogen dioxide and particulate material is substantially reduced to the point where they are no longer noxious. In the preferred embodiment, the noble metal coating applied to catalytic converter 16 is palladium and/or platinum. In addition, the cellular or honeycomb structure of the catalytic converter is preferably made from a ceramic material or stainless steel such that the catalytic converter is able to withstand the temperatures to which it may be subjected during operation of the fireplace.

Catalytic converter 16 operates at its peak efficiency when heated. Depending upon the nature of the converter and the particular noble metal utilized as a catalyst, to operate at a high level efficiency the converter must usually be heated to a temperature of a few hundred degrees Fahrenheit. In addition, in the preferred embodiment the cellular structure of the converter is such that it contains anywhere from approximately 16 to 500 individual cells or passageways per square inch of frontal surface area. It will be appreciated that the particular number of cells per square inch for a specific catalytic converter will be dependent upon the nature of the fuel being burned, the efficiency of the burner used in the fireplace, the output of the burner, the catalyst on the converter and the speed at which the converter must be heated to operate at peak efficiency.

Figure 4:
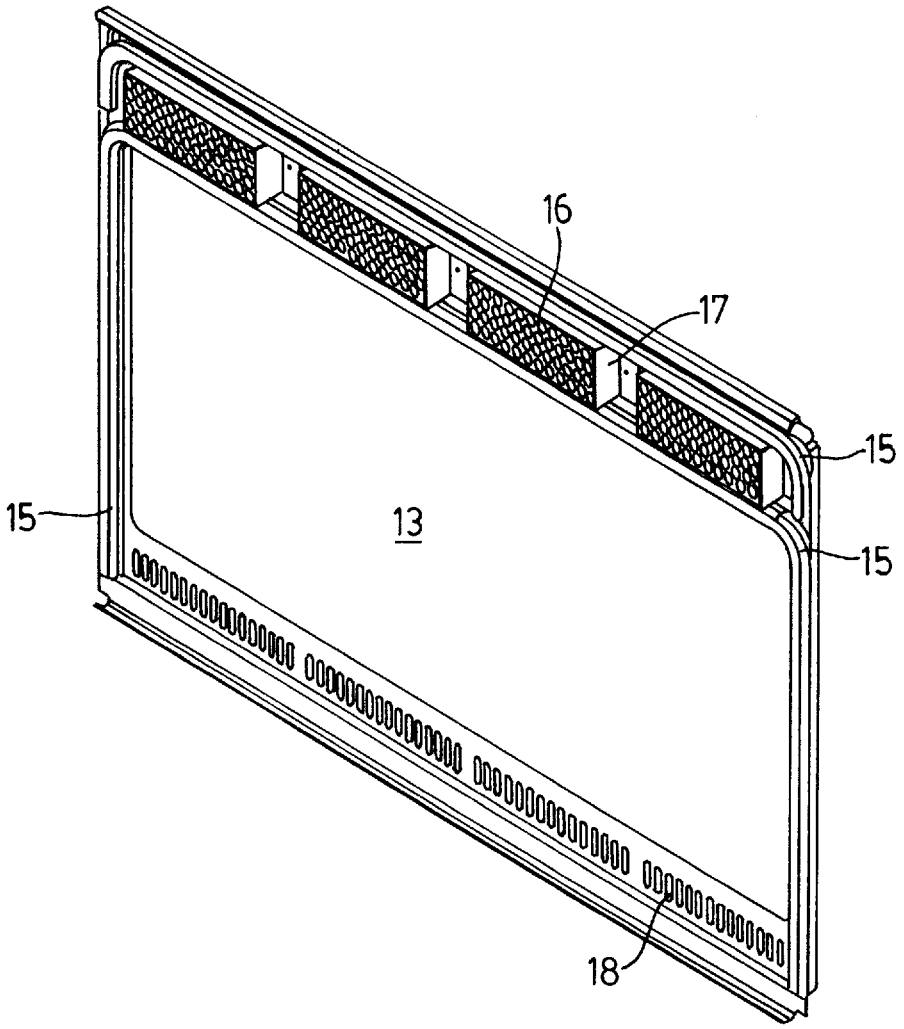
FIG. 4 is an upper rear perspective view of the door shown in FIG. 1.
Figure 5:
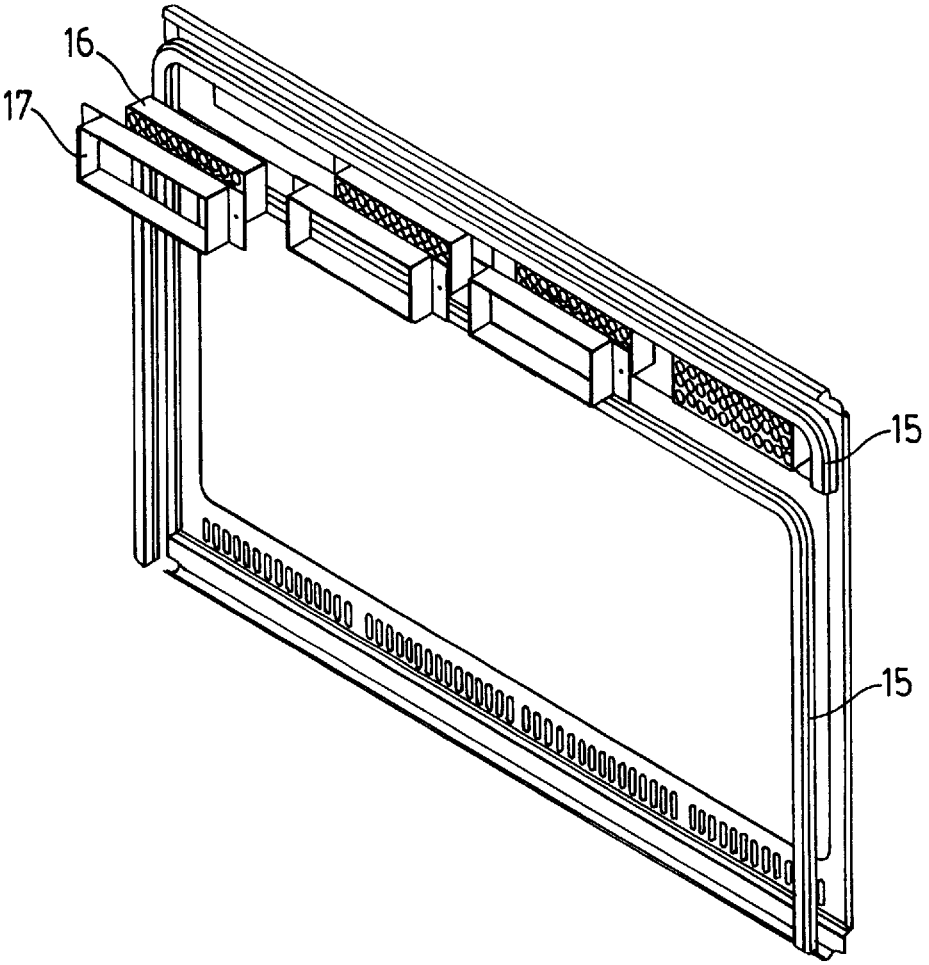
FIG. 5 is a partial exploded view of the door shown in FIG. 4.

As shown in FIGS. 3 and 4, catalytic converter 16 is preferably comprised of a plurality of individual catalytic converters positioned in a horizonal plane across the upper portion of door 8. The individual catalytic converters are secured to frame 9 through the use of retaining means 17 such that the converters can be removed periodically for cleaning, servicing or replacement, if necessary. In the preferred embodiment, and as shown in FIGS. 4 and 5, retaining means 17 comprise metal enclosures that surround the sides of each catalytic converter. The enclosures are secured to frame 9 through the use of screws, bolts, rivets or threaded studs.

Through positioning a series of catalytic converters horizontally across the upper portion of door 8 there will exist a substantial area through which exhaust gas is able to pass in order to prevent back pressure from developing within the firebox. In addition, if one converter were for some reason to become blocked or broken, the remaining converters would still be available to sulfficiently clean and expel the exhaust gases. To ensure that there is adequate flow of combustion air into the firebox for efficient operation door 8 preferably includes air intake slots 18 along its bottom portion.

Referring again to FIGS. 1 and 2, it will be appreciated that the positioning of catalytic converters 16 on the upper portion of door 8 will have the added beneficial effect of helping to radiate heat outwardly and directly into the room or environment in which the fireplace is situated. This has the effect of reducing the temperature to which the top of firebox 2 and exterior housing 3 are heated during operation of the fireplace. Encouraging a flow of exhaust gas through door 8, as opposed to through the top of the fireplace, assists in minimizing hot spots that can otherwise develop around a top vented firebox. Furthermore, the chemical reactions occurring within the catalytic converters during their operation are exothermic and the catalytic converters themselves may generate a significant amount of heat. Through placement and location of the catalytic converters on the front of the fireplace the heat that they generate is directed outwardly, by both radiation and convection, into the room in which the fireplace is situated, and not upwardly through the top of the firebox or exterior housing. For this reason the amount of insulation or baffling that is commonly installed in the top of a fireplace to combat heating of the upper portions is significantly reduced under the present invention. Furthermore, since the top portion of the firebox and the exterior housing of the fireplace are effectively kept cooler than other unvented fireplaces, the fireplace of FIGS. 1 and 7 is able to be installed with its upper surface in close proximity to combustible materials.

Figure 6:
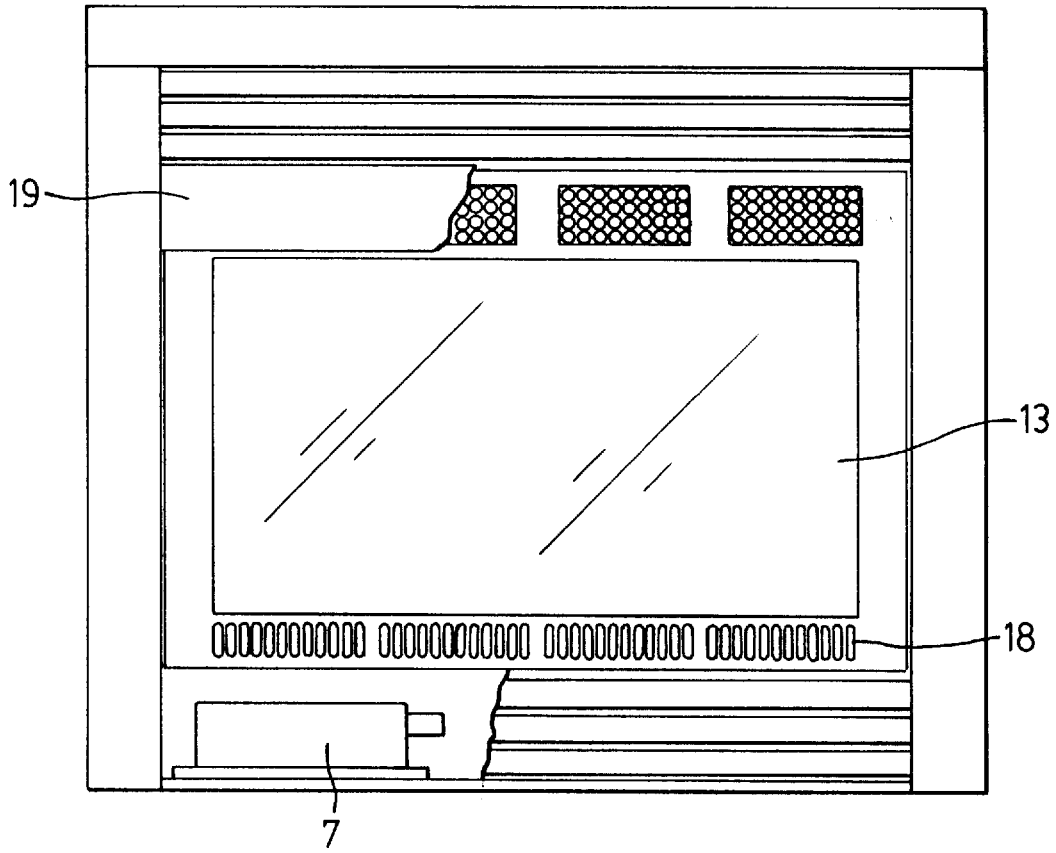
FIG. 6 is a front view of the fireplace shown in FIG. 1 with part of its upper and lower portions removed to reveal internal components; and, FIG. 7 is a side sectional view of an alternate embodiment of the invention.

For aesthetic purposes, and to provide a guard so as to prevent objects from coming into contact with the outer surface of catalytic converters 16, top portion 10 of frame 9 may be fitted with a hood 19 that traverses the front of door 8, as shown in FIGS. 1, 2 and 6. Hood 19 also helps to direct heat from the fireplace outwardly into the room.

It will be understood and appreciated that the structure of door 8 as described herein will enable it to be readily used on a variety of different unvented gas burning appliances. The structure and operation of the door enables it to be included in new installations of gas fireplaces and stoves, while at the same time providing for a means to retro-fit existing unvented fireplaces and stoves wherein exhaust gases are currently allowed to escape into the room through the open front of the firebox.

Figure 7:
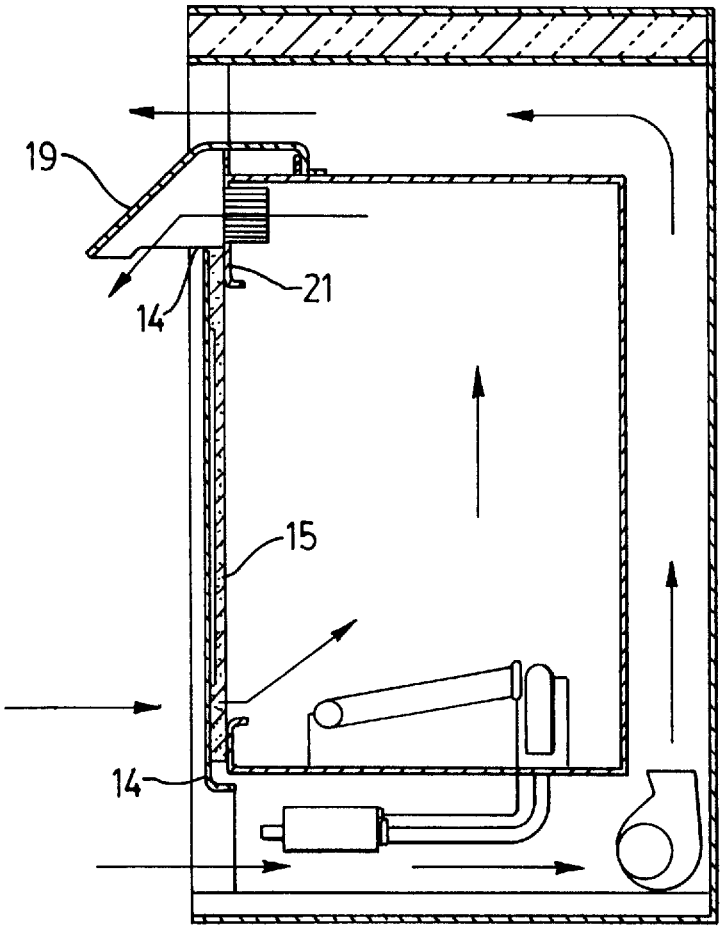

FIG. 7 shows a further embodiment of the present invention in which catalytic converters 16 are positioned directly within an upper enclosed portion 21 of the front of fireplace 1. That is, in this embodiment, as opposed to placing catalytic converters 16 within door 8, the converters are placed on the upper front portion of the front of the fireplace. Here the opening in the front of the fireplace will be somewhat smaller than in the previous embodiment shown in FIG. 1 through 6 and hence door 8 is also smaller in size and does not cover or encompass the catalytic converters. Aside from this structural change, the embodiment of the invention shown in FIG. 7 functions substantially the same as that described with respect to the embodiment shown in FIGS. 1 through 6.

It is to be understood that what has been described are the preferred embodiments of the invention and that it may be possible to make variations to these embodiments while staying within the broad scope of the invention. Some of these variations have been discussed while others will be readily apparent to those skilled in the art.

We claim:

1. A door for use on an unvented fuel burning appliance, the door comprising:

(i) a central panel member;

(ii) fastening means to allow said door to be releasably secured to the front of a fuel burning appliance; and, (iii) a catalytic converter, positioned in and near the top of said door, providing a means for the communication of air and gases through said door, such that when said door is installed on the front of a fuel burning appliance said catalytic converter is positioned on the upper front surface of the appliance requiring exhaust gases from the appliance to pass through said catalytic converter to escape the appliance, said catalytic converter reducing or eliminating the emission of harmful or noxious gases and particulate material in the exhaust gas created during the burning of fuel in the appliance, said catalytic converter further directing and radiating heat generated through its operation, and heat generated by said appliance, outwardly through the front of the appliance and reducing the amount of heat generated and maintained at the top of the appliance to thereby reduce the heating of the top surface of the appliance.

2. A device as claimed in claim 1 having sealing means located along the interior surface of the top portion of said central panel member and along the interior surface of at least the upper part of the side portions of said central panel member, said sealing means forming an air tight seal with the appliance when said door is releasably secured thereto, said air tight seal forcing exhaust gas from the appliance to pass thorough said catalytic converter prior to being expelled from the appliance.

3. A device as claimed in claim 2 including a plurality of catalytic converters positioned on a horizontal plane across the upper portion of said door.

4. A device as claimed in claim 3 including retaining means to releasably secure said catalytic converters to said door.

5. A device as claimed in claim 4 wherein said sealing means is comprised of a heat resistant gasket material.

6. A device as claimed in claim 5 having air intake slots to permit the entry of combustion air into the appliance when said door is installed thereon.

7. A device as claimed in claim 6 wherein said door is further comprised of a rigid exterior frame, having top, side and bottom portions, and a central viewing window contained and held by said frame.

8. A device as claimed in claim 7 wherein said viewing window is comprised of a heat resistant, transparent panel.

9. A device as claimed in claim 8 wherein said catalytic converter is a cellular structure having a plurality of independent channels therethrough.

10. A device as claimed in claim 9 wherein said catalytic converter is a ceramic material having a noble metal coating.

11. A device as claimed in claim 9 wherein said catalytic converter is comprised of stainless steel.

12. A device as claimed in claim 10 wherein said noble metal coating is palladium or platinum.

13. A device as claimed in claim 9 wherein said catalytic converter removes combustion by-products and reduces the expulsion of carbon monoxide, carbon dioxide and nitrogen dioxide into the room or environment where the appliance is situated.

14. An unvented fuel burning appliance comprising:

(i) a firebox having an open front and having enclosed bottom, rear, side and top surfaces;

(ii) a burner; and, (iii) a front door releasably securable to said firebox, said door comprising a central panel member and a catalytic converter positioned on the upper portion of said central panel member, wherein exhaust gases from said burner are directed through said catalytic converter prior to exiting said firebox such that said catalytic converter eliminates or reduces harmful or noxious gases and particulate material contained within the exhaust gases, and wherein heat generated by the operation of said catalytic converter is substantially directed, by way of radiation and convection, outwardly thorough the front of said appliance to reduce heat generated and maintained at the top of said firebox and thereby reduce the heating of the top surface of said appliance.

15. An unvented fuel burning appliance comprising:

(i) a firebox having a partially enclosed front and having enclosed bottom rear, side and top surfaces;

(ii) a burner; and, (iii) a catalytic converter positioned on the upper portion of said partially enclosed front of said firebox, wherein exhaust gases from said burner are directed through said catalytic converter prior to exiting said firebox such that said catalytic converter eliminates or reduces harmful or noxious gases and particulate material within the exhaust gases, and wherein heat generated by the operation of said catalytic converter is substantially directed, by way of radiation and convection, outwardly through the front of said fireplace to reduce heat generated and maintained at the top of said firebox and thereby reduce the heating of the top surface of said appliance.

16. A device as claimed in claim 15 including a plurality of catalytic converters positioned on a horizontal plane across the upper portion of said front of said firebox.

17. A device as claimed in claim 16 including a door to fully enclose the open portion of said front of firebox, said door preventing exhaust gases from said burner from being expelled from said firebox without being directed through said catalytic converter.

* * * * *